US007413177B2

(12) United States Patent
Mori et al.

(10) Patent No.: US 7,413,177 B2
(45) Date of Patent: Aug. 19, 2008

(54) SHEET PROCESSING APPARATUS, METHOD OF CONTROLLING THE SHEET PROCESSING APPARATUS, CONTROL PROGRAM FOR IMPLEMENTING THE METHOD, AND STORAGE MEDIUM STORING THE CONTROL PROGRAM

(75) Inventors: Akihito Mori, Toride (JP); Nobuo Sekiguchi, Moriya (JP); Takashi Nagaya, Moriya (JP); Keita Takahashi, Abiko (JP)

(73) Assignee: Canon Kabushiki Kaisha (JP)

( * ) Notice: Subject to any disclaimer, the term of this patent is extended or adjusted under 35 U.S.C. 154(b) by 235 days.

(21) Appl. No.: 11/185,028

(22) Filed: Jul. 19, 2005

(65) Prior Publication Data

US 2006/0018696 A1 Jan. 26, 2006

(30) Foreign Application Priority Data

Jul. 20, 2004 (JP) ..... 2004-211473

(51) Int. Cl.
*B65H 37/04* (2006.01)

(52) U.S. Cl. ..... 270/58.09; 270/58.04; 270/58.07; 270/58.08; 271/220

(58) Field of Classification Search ..... 270/58.04, 270/58.07, 58.08, 58.09; 271/288, 176, 207, 271/215, 220; 399/407, 408, 409, 410
See application file for complete search history.

(56) References Cited

U.S. PATENT DOCUMENTS 4,878,656 A * 11/1989 Honjo et al. ..... 270/58.09
5,990,438 A * 11/1999 Yamashita et al. ..... 209/584
6,070,023 A * 5/2000 Kataoka ..... 399/45

FOREIGN PATENT DOCUMENTS

JP 7-165363 A 6/1995
JP 8-301504 A 11/1996
JP 10-7314 A 1/1998
JP 10-181236 A 7/1998
JP 2000025982 A * 1/2000
JP 2000-318918 A 11/2000
JP 2001-171898 A 6/2001
JP 2005-35057 A 2/2005

* cited by examiner

*Primary Examiner*—Gene O. Crawford
*Assistant Examiner*—Leslie Nicholson, III
(74) *Attorney, Agent, or Firm*—Rossi, Kimms & McDowell LLP

(57) ABSTRACT

A sheet processing apparatus which makes it possible to carry out optimal bundling, such as bookbinding, according to sheet thickness, thereby enhancing the operability of the apparatus. A sensor LED control section 114 detects the thickness of a bundle of sheets to be processed. A post-processing control section 115 calculates a thickness of each sheet based on the thickness of the bundle of sheets detected by the sensor LED control section 114. The post-processing control section 115 changes the upper limit of the number of sheets that can be processed as a bundle based on the calculated thickness of each sheet.

16 Claims, 11 Drawing Sheets

FIG. 8

| |
|---|
| SHEET SIZE |
| SHEET TYPE |
| SHEET THICKNESS |
| BUNDLE LIMIT |

*FIG. 9*

| SHEET TYPE | SHEET THICKNESS | BUNDLE LIMIT |
|---|---|---|
| THIN PAPER | 0.05mm | 400 SHEETS (20mm) |
| PLAIN PAPER | 0.1mm | 200 SHEETS (20mm) |
| THICK PAPER | 0.2mm | 100 SHEETS (20mm) |
| VERY THICK PAPER | 0.3mm | 66 SHEETS (20mm) |

SHEET PROCESSING APPARATUS, METHOD OF CONTROLLING THE SHEET PROCESSING APPARATUS, CONTROL PROGRAM FOR IMPLEMENTING THE METHOD, AND STORAGE MEDIUM STORING THE CONTROL PROGRAM

BACKGROUND OF THE INVENTION

1. Field of the Invention

The present invention relates to a sheet processing apparatus, such as an image forming apparatus provided with a LBP (laser beam printer) or a copying machine, which is capable of recording images on sheets, such as paper sheets, using the electrophotographic printing method, and a bookbinding device as an application device of the copying machine, such as a finisher, a sorter, or a stacker, a method of controlling the sheet processing apparatus, a control program for implementing the control method, and a storage medium storing the control program.

2. Description of the Related Art

In conventional bookbinding devices, the number of sheets that can be stapled e.g. by a sorter or a finisher which is capable of performing stapling processing varies depending on the sheet size and the sheet thickness.

In the case of a so-called plain sheet having a predetermined thickness e.g. of 0.1 mm, the maximum number of A4-size sheets that can be stapled as a bundle is 50, whereas that of A3-size sheets that can be stapled as a bundle is only 40.

In the case of a so-called thick paper sheet being thicker than a plain sheet and having a thickness e.g. of 0.2 mm, the maximum number of A4-size sheets that can be stapled as a bundle is 30, whereas that of A3-size sheets that can be stapled as a bundle is only 20.

Thus, the number of sheets that can be bundled varies depending on the sheet type, and the maximum processable number of sheets is determined based on the size and thickness of the sheet.

Information on sheet thicknesses is entered by the user or registered in advance as fixed values in the apparatus. Some bookbinding apparatuses measure the thickness of each sheet when the sheet is fed.

Japanese Laid-Open Patent Publications (Kokai) Nos. H07-165363 and H08-301504 disclose a mechanism that detects the thickness of a bundle of sheets. According to the mechanism disclosed in the former publication, the thickness of a sheet bundle in one processing section is detected, and when the thickness of the sheet bundle reaches a predetermined value, subsequent sheets are received and aligned in another processing section, and discharged out of an apparatus including the mechanism without being bound. According to the mechanism disclosed in the latter publication, based on a result of detection by detection means for detecting the thickness of a sheet bundle stored in a tray, sheets to be guided into a sheet tray are temporarily stored at a predetermined position.

Further, Japanese Laid-Open Patent Publications (Kokai) Nos. H10-007314 and No. 2000-318918 disclose an apparatus that detects the thickness of a bundle of sheets and controls the position of a guide for sandwiching the bundle and carrying out processing thereafter, and an apparatus that performs stapling processing by selectively using a plurality of stapling devices, respectively.

Furthermore, there has been-proposed a tape-binding device e.g. in Japanese Laid-Open Patent Publication (Kokai) No. H10-181236, in which several types of binding tapes different in width are selectively supplied to a tape heating device according to the thickness of a sandwiched sheet bundle.

In the above described prior art in which the upper limit of the number of sheets to be bundled or that of the thickness of the sheet bundle is set according to the sheet type (sheet thickness). However, in the case of the upper limits being specified based on weight, the limit of sheet thickness cannot be determined accurately due to difference between the measure of weight and that of sheet thickness, and hence limit values have to be set with an allowance for the upper limit of the number of sheets to be bundled or that of sheet bundle thickness.

For this reason, to enable a predetermined number of e.g. A4-size plain sheets of any type to be bundled insofar as they are categorized as A4-size plain sheets, the number of A4-size plain sheets that can be bundled is limited to 50 even when up to 100 of them can be bundled in actuality. Thus, even plain sheets of a size that can actually be processed as a bundle of up to 100 sheets are categorized into a group having an upper limit of 50 sheets for bundling.

Similarly, even an apparatus which is capable of detecting sheet thickness on a sheet-by-sheet basis, stores not information on the thickness of each sheet, but only information on categories of sheet types, such as plain sheet, thick paper, and so forth. Therefore, the upper limits of the number or thickness of sheets of types in a category, which can be processed as a bundle, are determined to be within an upper limit thereof set for the category.

In recent years, the type of sheets for use in an image forming apparatus has become diversified, which causes diversity in sheet thickness within each category. In response to this tendency, measures are being taken e.g. to increase the number of categories.

However, even if the number of types to be set is sufficiently increased, bundling is executed based on preset upper limits of the number of sheets and sheet bundle thickness. Therefore, assuming that sheets smaller in thickness than an assumed sheet thickness are to be bundled, even after sheets are stored in a predetermined number corresponding to the upper limit for bundling, there still remains room for increasing the number of sheets that can be bundled. On the other hand, assuming that sheets larger in thickness than an assumed sheet thickness are to be bundled, when sheets are stored for bundling in a number corresponding to the upper limit, the thickness of a bundle of the sheets exceeds the maximum allowable thickness, which can cause degradation of finishing due to occurrence of wrinkling, faulty binding, or the like.

As far as detection of sheet thickness is concerned, a sheet is heated and pressed for fixing while passing through a fixing device, and therefore the thickness of a sheet is smaller when the sheet has passed through the fixing device than that detected before passing through the fixing device. This is because heat from the fixing device evaporates water contained in the sheet, and pressure applied to the sheet compresses or flattens spaces within the sheet. Further, since a sheet bundle is pressed and sandwiched for bundling, and the sheet bundle is further pressed for bonding spaces between a plurality of sheets to be bundled are eliminated, whereby the thickness of the sheet bundle changes.

That is, in conventional bundling, it is general that sheet thickness detected before fixing is used in bundling which should be carried out after measurement of the thickness of a sheet bundle.

Therefore, in view of finishing of bookbinding, it is preferred that the thickness of a sheet bundle is measured after fixing and during bundling.

SUMMARY OF THE INVENTION

It is an object of the present invention to provide a sheet processing apparatus, and a method of controlling the sheet processing apparatus, which make it possible to carry out optimal bundling, such as bookbinding, according to sheet thickness, thereby enhancing the operability of the apparatus, and a control program for implementing the control method, and a storage medium storing the control program.

To attain the above object, in a first aspect of the present invention, there is provided a sheet processing apparatus for processing a plurality of sheets as a bundle comprising a sheet bundle thickness-detecting sensor that detects a thickness of the bundle of sheets, a sheet thickness-calculating device that calculates a thickness of each sheet based on the thickness of the bundle of sheets detected by the sheet bundle thickness-detecting sensor, and a changing device that changes an upper limit of a number of sheets that can be processed as a bundle based on the thickness of each sheet calculated by the sheet thickness-calculating device.

Preferably, the sheet processing apparatus comprises a pressing member that presses the bundle of sheets, and the sheet bundle thickness-detecting sensor detects the thickness of the bundle of sheets the bundle of sheets is pressed by the pressing member.

Preferably, the sheet processing apparatus comprises a sheet thickness information storage section that stores per-sheet thickness information indicative of the thickness of each sheet, and the changing device rewrites the per-sheet thickness information stored in the sheet thickness information storage section, according to the thickness of each sheet calculated by the sheet thickness-calculating device.

Preferably, the sheet processing apparatus comprises a sheet counter that counts a number of sheets to be processed as a bundle, and the sheet thickness-calculating device calculates the thickness of each sheet by dividing the thickness of the bundle of sheets detected by the sheet bundle thickness-detecting sensor by a count value of the sheet counter.

More preferably, the sheet processing apparatus comprises a sheet thickness information storage section that stores per-sheet thickness information indicative of the thickness of each sheet calculated by the sheet thickness-calculating device.

More preferably, the sheet processing apparatus comprises a determining device that determines whether or not the plurality of sheets are to be used for a first time, and a sheet thickness information storage section that is operable when the determining device determines the plurality of sheets are to be used for the first time, to construct and store a table containing per-sheet thickness information indicative of the thickness of each sheet calculated by the sheet thickness-calculating device.

Preferably, the sheet processing apparatus comprises an original counter that counts a number of originals, a processing mode-designating device that designates one processing mode selected from the group consisting of a single-sided mode, a double-sided mode, and a reduction layout mode, an output sheet number-calculating device that calculates a number of the sheets to be outputted for processing, based on a count value of the original counter, and the processing mode designated by the processing mode-designating device, and a warning device that compares the number of the sheets to be outputted calculated by the output sheet number-calculating device with the upper limit of the number of sheets that can be processed as a bundle, and gives a warning when the number of the sheets to be outputted exceeds the upper limit.

Preferably, the sheet processing apparatus comprises an original counter that counts a number of originals, a processing mode-designating device that designates one processing mode selected from the group consisting of a single-sided mode, a double-sided mode, and a reduction layout mode, an output sheet number-calculating device that calculates a number of the sheets to be outputted for processing, based on a count value of the original counter, and the processing mode designated by the processing mode-designating device, a setting device that sets at least one of a sheet feed stage and a type of the sheets to be processed, and a warning device that compares the number of the sheets to be outputted calculated by the output sheet number-calculating device with the upper limit of the number of sheets that can be processed as a bundle using at least one of the sheet feed stage and the type of the sheets to be processed set by the setting device, and gives a warning when the number of the sheets to be outputted exceeds the upper limit.

Alternatively, the sheet processing apparatus comprises a sheet thickness information storage section that stores per-sheet thickness information indicative of the thickness of each sheet, set for each of at least one sheet feed stage, a setting device that sets a sheet feed stage, an output sheet number-calculating device that calculates a number of the sheets to be outputted for processing, and a warning device that compares the upper limit of the number of the sheets that can be processed as a bundle determined from the per-sheet thickness information set for the set sheet feed stage, with the calculated number of the sheets to be outputted, and gives a warning when the calculated number of the sheets to be outputted exceeds the upper limit.

To attain the above object, in a second aspect of the present invention, there is provided a method of controlling a sheet processing apparatus that processes a plurality of sheets as a bundle, comprising a sheet bundle thickness-detecting step of detecting a thickness of the bundle of sheets, a sheet thickness-calculating step of calculating a thickness of each sheet based on the thickness of the bundle of sheets detected in the sheet bundle thickness-detecting step, and a changing step of changing an upper limit of a number of sheets that can be processed as a bundle based on the thickness of each sheet calculated in the sheet thickness-calculating step.

Preferably, the method comprises a pressing step of pressing the bundle of sheets, and the sheet bundle thickness-detecting step comprises detecting the thickness of the bundle of sheets in a state where the bundle of sheets is pressed in the pressing step.

Preferably, the method comprises a sheet thickness information storing step of storing per-sheet thickness information indicative of the thickness of each sheet in a sheet thickness information storage section, and the changing step comprises rewriting the per-sheet thickness information stored in the sheet thickness information storage section, according to the thickness of each sheet calculated in the sheet thickness-calculating step.

Preferably, the method comprises a sheet counting step of counting a number of sheets to be processed as a bundle, and the sheet thickness-calculating step comprises calculating the thickness of each sheet by dividing the thickness of the bundle of sheets detected in the sheet bundle thickness-detecting step by a count value obtained in the sheet counting step.

More preferably, the method comprises a sheet thickness information storing step of storing per-sheet thickness information indicative of the thickness of each sheet calculated in the sheet thickness-calculating step, in the sheet thickness information storage section.

More preferably, the method comprises a determining step of determining whether or not the plurality of sheets are to be used for a first time, and a sheet thickness information storing step of constructing and storing a table containing per-sheet thickness information indicative of the thickness of each sheet calculated in the sheet thickness-calculating step, when it is determined in the determining step that the plurality of sheets are to be used for the first time.

Preferably, the method comprises an original counting step of counting a number of originals, a processing mode-designating step of designating one processing mode selected from the group consisting of a single-sided mode, a double-sided mode, and a reduction layout mode, an output sheet number-calculating step of calculating a number of the sheets to be outputted for processing, based on a count value obtained in the original counting step, and the processing mode designated in the processing mode-designating step, and a warning step of comparing the number of the sheets to be outputted calculated in the output sheet number-calculating step with the upper limit of the number of sheets that can be processed as a bundle, and giving a warning when the number of the sheets to be outputted exceeds the upper limit.

Preferably, the method comprises an original counting step of counting a number of originals, a processing mode-designating step of designating one processing mode selected from the group consisting of a single-sided mode, a double-sided mode, and a reduction layout mode, an output sheet number-calculating step of calculating a number of the sheets to be outputted for processing, based on a count value obtained in the original counting step, and the processing mode designated in the processing mode-designating step, a setting step of setting at least one of a sheet feed stage and a type of the sheets to be processed, and a warning step of comparing the number of the sheets to be outputted calculated by the output sheet number-calculating device with the upper limit of the number of sheets that can be processed as a bundle using at least one of the sheet feed stage and the type of the sheets to be processed set in the setting step, and giving a warning when the number of the sheets to be outputted exceeds the first upper limit.

Alternatively, the method comprises a sheet thickness information storing step of storing per-sheet thickness information indicative of the thickness of each sheet, set for each of at least one sheet feed stage, in a sheet thickness information storage section, a setting step of setting a sheet feed stage, an output sheet number-calculating step of calculating a number of the sheets to be outputted for processing, and a warning step of comparing the upper limit of the number of the sheets that can be processed as a bundle determined from the per-sheet thickness information set for the set sheet feed stage, with the calculated number of the sheets to be outputted, and gives a warning when the calculated number of the sheets to be outputted exceeds the upper limit.

To attain the above object, in a third aspect of the present invention, there is provided a control program for causing a computer to execute a method of controlling a sheet processing apparatus that processes a plurality of sheets as a bundle, comprising a sheet bundle thickness-detecting module for detecting a thickness of the bundle of sheets, a sheet thickness-calculating module for calculating a thickness of each sheet based on the thickness of the bundle of sheets detected by the sheet bundle thickness-detecting module, and a changing module for changing an upper limit of a number of sheets that can be processed as a bundle based on the thickness of each sheet calculated by the sheet thickness-calculating module.

To attain the above object, in a fourth aspect of the present invention, there is provided a computer-readable storage medium storing the control program according to the third aspect of the present invention.

The above and other objects, features, and advantages of the invention will become more apparent from the following detailed description taken in conjunction with the accompanying drawings.

BRIEF DESCRIPTION OF THE DRAWINGS

FIG. 8 is a diagram of an example of a sheet table stored in the image forming apparatus in FIG. 1, for showing sheet information;

FIG. 9 is a diagram of an example of a table showing initial values of sheet information in the case where a sheet size is A4 in the sheet table in FIG. 8;

DETAILED DESCRIPTION OF THE PREFERRED EMBODIMENTS

The present invention will now be described in detail below with reference to the drawings showing a preferred embodiment thereof.

Figure 1:
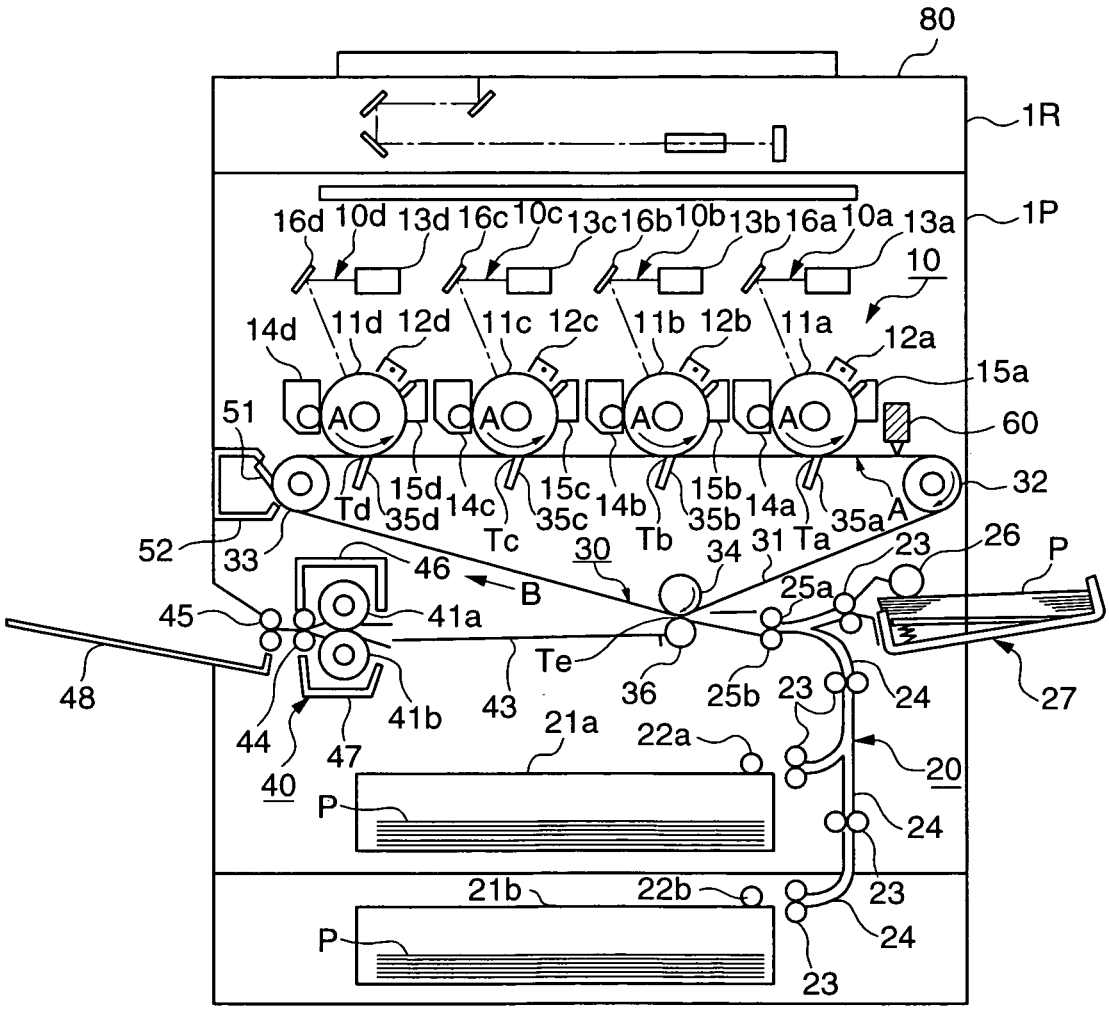
FIG. 1 is a longitudinal cross-sectional view schematically showing the construction of an image forming apparatus implementing a sheet processing apparatus according to an embodiment of the present invention.

FIG. 1 is a longitudinal cross-sectional view schematically showing the construction of an image forming apparatus implementing a sheet processing apparatus according to an embodiment of the present invention.

The image forming apparatus is a color image forming apparatus comprised of an optical system 1R and an image output section 1P. The apparatus employs the electrophotographic printing method in which the optical system 1R reads in an original image, and the image output section 1P forms an image on a transfer material (sheet) P based on information on the original image from the optical system 1R. Further, in the image output section 1P, there is disposed an image forming section 10 having a plurality of stations identical in construction and arranged parallel with each other, to which the present invention is deemed to be particularly effectively applicable, and the intermediate transfer method is adopted.

Figure 2:
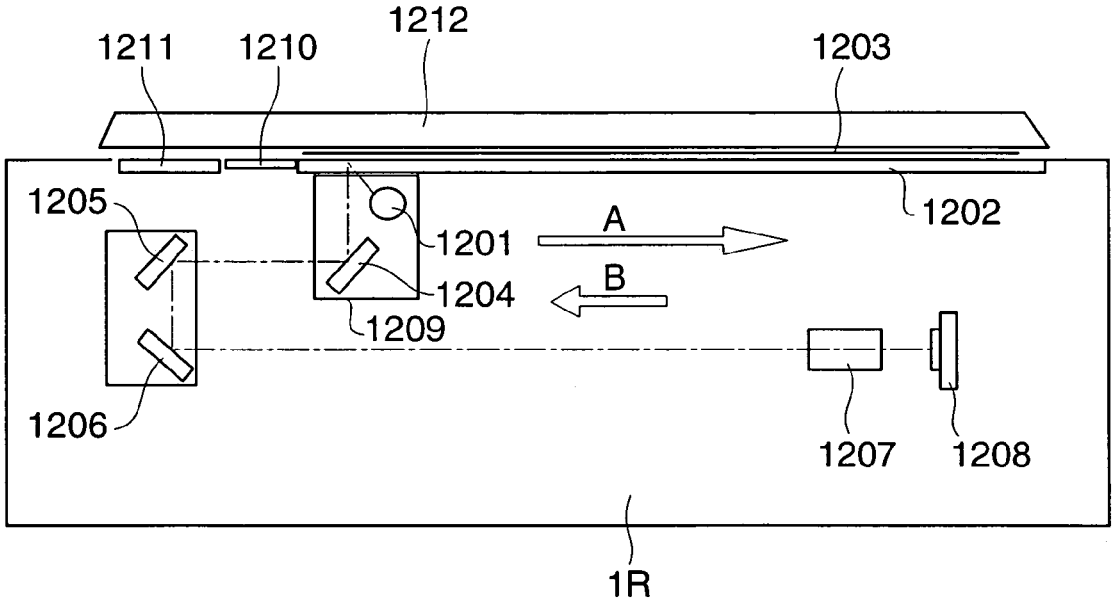
FIG. 2 is an enlarged longitudinal cross-sectional view showing details of the construction of an image reader of the image forming apparatus in FIG. 1.

FIG. 2 is an enlarged longitudinal cross-sectional view showing details of the construction of the optical system 1R appearing in FIG. 1. As shown in FIG. 2, the optical system 1R is comprised of an original illuminating lamp 1201, an original platen glass 1202, a first mirror 1204, a second mirror 1205, a third mirror 1206, a lens 1207, a color CCD 1208, a shading correction plate 1210, a moving original reading window 1211, and a presser plate 1212. An original 1203 is placed on the original platen glass 1202. The original illuminating lamp 1201 and the first mirror 1204 form a reader section 1209.

As shown in FIG. 2, an image of the original 1203 placed on the original platen glass 1202 illuminated by the original illuminating lamp 1201 is formed on the color CCD 1208 via the first mirror 1204, the second mirror 1205, the third mirror 1206, and the lens 1207, whereby line images of the original 1203 are read. The reader section 1209 sequentially reads the line images while moving in a direction indicated by the arrow A appearing in FIG. 2. In doing this, a drive system, not shown, drives a section comprised of the second mirror 1205 and the third mirror 1206 such that the section is also moved in the direction indicated by the arrow A while holding constant the distance (optical path length) between a surface of the original 1203 and the color CCD 1208.

Now, a description will be given of a sequence in which an original image on the original 1203 is actually read by the optical system 1R in FIG. 2.

When an operator inputs an original reading command (e.g. by depressing a copy button), the optical system 1R causes the reader section 1209, by a drive system, not shown, to move from a position in FIG. 2 (which is set as a home position) in a direction indicated by the arrow B in FIG. 2, to a position immediately below the shading correction plate 1210 (hereinafter referred to as "the reading position"). Then, the optical system 1R turns on the original illuminating lamp 1201 to illuminate the shading correction plate 1210, thereby guiding a line image from the shading correction plate 1210 to the color CCD 1208 via the first mirror 1204, the second mirror 1205, the third mirror 1206, and the lens 1207.

The color CCD 1208 reads the line image from the shading correction plate 1210, and pixel-by-pixel output signals of the read line image are subjected to shading correction by an image processing circuit, not shown, such that the output levels of all the pixels become equal to a predetermined level. Image processing including the shading correction corrects uneven illuminance of the original illuminating lamp 1201, reduced light quantity on the periphery of the lens 1207, pixel-by-pixel variations in sensitivity of the color CCD 1208, and so forth, whereby uneven image reading of an original is corrected. When the shading correction is completed, the reader section 1209 is driven by the drive system, not shown, to further move in the direction indicated by the arrow B in FIG. 2 to a position immediately below the moving original reading window 1211 (which will be described in detail hereinafter).

The position immediately below the moving original reading window 1211 is the start position for reading an original image. The drive system, not shown, is controlled to move the reader section 1209 from the start position in the direction indicated by the arrow A in FIG. 2 while accelerating the same so that the reader section 1209 is moved at a predetermined constant speed before the reading position reaches a position just below the leading end of the original 1203 which is pressed by the presser plate 1212 such that flatness thereof is maintained.

When the reading position of the reader section 1209 reaches the position just below the leading end of the original 1203, the color CCD 1208 starts an operation for sequentially reading line images of the original 1203 at the constant speed.

The drive system, not shown, moves the reader section 1209 at the constant speed in the direction indicated by the arrow A in FIG. 2. Then, after reading of the original 1203 up to the trailing end thereof has been completed, the drive system stops driving the reader section 1209, and moves the same in the direction indicated by the arrow B in FIG. 2 to the position shown in FIG. 2, i.e. to its home position, followed by terminating the sequential image reading processing and entering a standby state for next reading processing.

Thus, the basic image reading operation of the optical system 1R is completed.

Nowadays, it is not rare that the optical system 1R configured as above has an automatic document feeder (ADF) mounted thereon as standard equipment. The ADF is equipped with a function of automatically feeding a large number of originals in succession, so that the use of the ADF makes it possible to save the trouble of replacing originals one by one, thereby reducing copying time.

In the following, a description will be given of a reading operation performed using an ADF with reference to FIG. 3.

Figure 3:
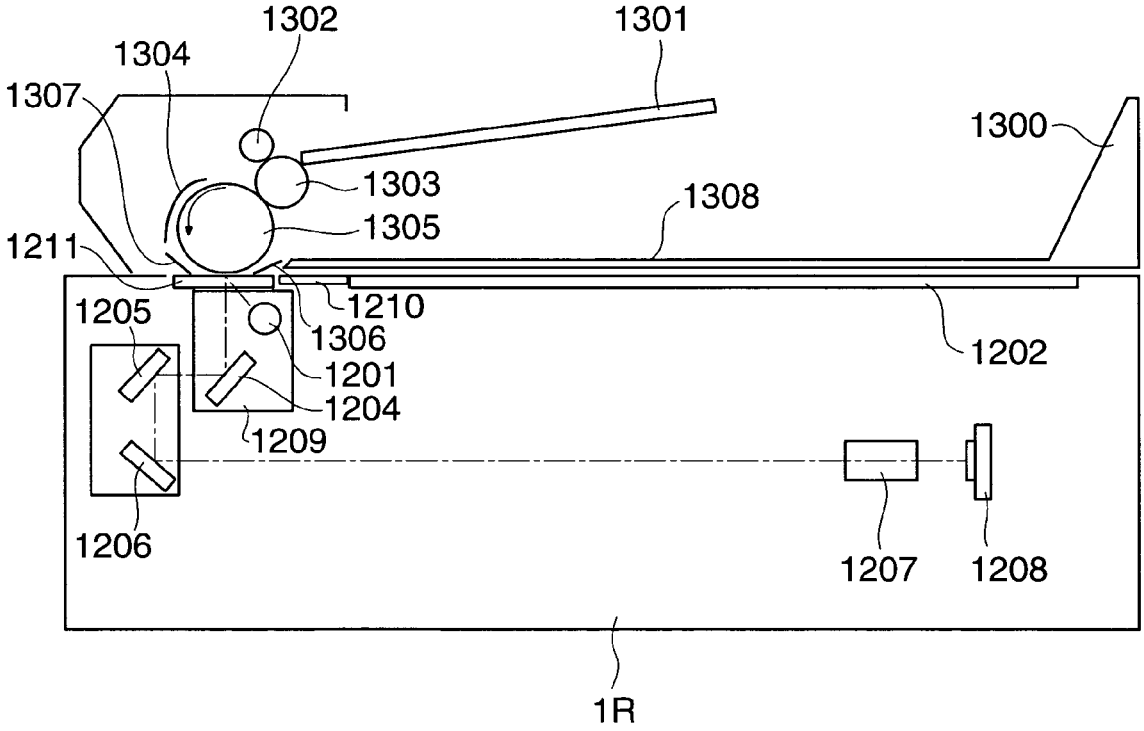
FIG. 3 is a longitudinal cross-sectional view schematically showing the construction of an original feeder mounted on the image reader in FIG. 2.

FIG. 3 is a longitudinal cross-sectional view schematically showing the construction of the optical system 1R provided with the ADF. In FIG. 3, component parts and elements corresponding to those shown in FIG. 2 are designated by identical reference numerals.

As shown in FIG. 3, the ADF 1300 mounted on the optical system 1R in FIG. 2 is comprised of a feed tray 1301, a pair of feed rollers 1302 and 1303, a guide 1304, a conveying roller 1305, guides 1306 and 1307, and a discharge tray 1308.

As shown in FIG. 3, in the optical system 1R in which the ADF 1300 replaces the presser plate 1212 appearing in FIG. 2, when the operator inputs an original reading command (e.g. by depressing the copy button) in a state where the reader section 1209 is at its home position (i.e. its position in FIG. 2), the drive system, not shown, and the image processing circuit, not shown, execute image processing including the shading correction described above with reference to FIG. 2, and then the drive system moves the associated components to respective positions shown in FIG. 3, and fixedly positions the reader section 1209.

This position of the reader section 1209 corresponds to the start position described above with reference to FIG. 2. Just above the start position, there is disposed the moving original reading window 1211. In the case where the ADF 1300 is used for reading, a plurality of originals are placed on the feed tray 1301. When the original reading operation is started, the originals are fed one by one by the feed rollers 1302 and 1303, conveyed by the conveying roller 1305, which performs rotation in a direction indicated by the arrow in FIG. 3, through a slit formed between the guides 1304, 1307 and 1306 and the conveying roller 1305, and discharged onto the discharge tray 1308.

The rotational speed of the conveying roller 1305 is determined according to a reading magnification, described hereinafter. An image of each original conveyed by the conveying roller 1305 is read through the moving original reading window 1211 by the color CCD 1208 via the reader section 1209.

As described above, line image data of an original image read by the optical system 1R constructed as shown in FIG. 2 or 3 are sequentially delivered to the image output section 1P, and the image output section 1P forms images on a transfer material P based on the images read from the original.

Next, a description will be given of the construction of the image output section 1P with reference to FIG. 1.

The image output section 1P is basically comprised of the image forming section 10, a feeder unit 20, an intermediate transfer unit 30, a fixing unit 40, and a control section 80. The image forming section 10 has four stations 10*a*, 10*b*, 10*c*, and 10*d* arranged parallel with each other. The stations 10*a* to 10*d* are identical in construction to each other.

Further, a detailed description will be given of each of the units.

The image forming section 10 is constructed as described as follows.

Photosensitive drums 11*a*, 11*b*, 11*c*, and 11*d* as image carriers are rotatably supported at the center thereof and each driven to perform rotation in a direction indicated by the arrow A in FIG. 1. Primary electrostatic chargers 12*a*, 12*b*, 12*c*, and 12*d*, exposure sections 13*a*, 13*b*, 13*c*, and 13*d* to which image information is transmitted from the optical system 1R, turning-back mirrors 16*a*, 16*b*, 16*c*, and 16*d*, and developing sections 14*a*, 14*b*, 14*c*, and 14*d* are disposed in facing relation to the outer peripheral surfaces of the associated ones of the photosensitive drums 11*a* to 11*d*. The primary electrostatic charger, the exposure section, the turning-back mirror, and the developing section are arranged in the direction of rotation of the photosensitive drum in the mentioned order.

The primary electrostatic chargers 12*a* to 12*d* apply a uniform amount of electric charge to the surfaces of the respective photosensitive drums 11*a* to 11*d*. Then, light beams, such as laser beams, having a wavelength thereof modulated in accordance with a image signal to be recorded are applied by the exposure sections 13*a* to 13*d* to the respective photosensitive drums 11*a* to 11*d* via the respective turning-back mirrors 16*a* to 16*d*, whereby an electrostatic latent image is formed on each of the photosensitive drums 11*a* to 11*d*.

Further, the electrostatic latent images are visualized by the respective developing sections 14*a* to 14*d* containing respective developers (hereinafter referred to as "toners") of four colors, i.e. yellow, cyan, magenta, and black. The visualized images (developed images) are sequentially transferred onto an intermediate transfer belt 31 as an intermediate transfer member in respective primary transfer areas Td, Tc, Tb, and Ta.

In accordance with rotation of the photosensitive drums 11*a* to 11*d*, toners left on the photosensitive drums 11*a* to 11*d* without being transferred onto the intermediate transfer belt 31 are scraped off by the respective associated cleaning sections 15*a*, 15*b*, 15*c*, and 15*d*, downstream of the associated primary image transfer areas Ta to Td, whereby the respective surfaces of the photosensitive drums 11*a* to 11*d* are cleaned.

The images of the respective toners are sequentially formed by the above described process.

The feeder unit 20 is comprised of cassettes 21*a* and 21*b* which contain transfer materials P, a manual feed tray 27, pickup rollers 22*a*, 22*b*, and 26 for feeding transfer materials P one by one from the cassettes 21*a* and 21*b* and the manual feed tray 27, respectively, a feed roller pair 23 and a feed guide 24 for conveying the transfer materials P fed by the pickup rollers 22*a*, 22*b*, and 26 to registration rollers 25*a* and 25*b*, and the registration rollers 25*a* and 25*b* for conveying the transfer materials P to a secondary transfer area Te in timing synchronous with image formation in the image forming section 10.

Next, a detailed description will be given of the intermediate transfer unit 30.

The intermediate transfer belt 31 is an endless belt wound around a drive roller 32 for transmitting a drive force to the intermediate transfer belt 31, a driven roller 33 driven by rotation of the intermediate transfer belt 31, and a counter roller 34 opposed to the secondary transfer area Te via the intermediate transfer belt 31, as winding rollers. A primary transfer plane A is formed between the drive roller 32 and the driven roller 33. The drive roller 32 is formed by coating a metal roller with a rubber (urethane rubber or chloroprene rubber) layer having a thickness of several millimeters, so as to prevent a slip between the intermediate transfer belt 31 and the drive roller 32 itself. The drive roller 32 is driven by a pulse motor, not shown, to perform rotation in a direction indicated by the arrow B in FIG. 1.

The primary transfer plane A of the intermediate transfer belt 31 extends in facing relation to the stations 10*a* to 10*d* of the image forming section 10 such that the photosensitive drums 11*a* to 11*d* face the primary transfer plane A. Thus, the primary image transfer areas Ta to Td are arranged on the primary transfer plane A.

Primary transfer electrostatic chargers 35*a* to 35*d* opposed to the respective photosensitive drums 11*a* to 11*d* are disposed in the primary image transfer areas Ta to Td, respectively. A secondary transfer roller 36 which is opposed to the counter roller 34 forms the secondary transfer area Te, by a nip between the intermediate transfer belt 31 and the secondary transfer roller 36 itself. The secondary transfer roller 36 is pressed against the intermediate transfer belt 31 under moderate pressure. Further, at a location downstream of the secondary transfer area Te on the intermediate transfer belt 31, there are provided a cleaning blade 51 for cleaning the image forming surface of the intermediate transfer belt 31, and a waste toner box 52 for receiving waste toner.

The fixing unit 40 includes a fixing roller 41*a* containing a heat source, such as a halogen heater, a fixing roller 41*b* pressed against the fixing roller 41*a*, a guide 43 for guiding a transfer material P into a nip part of the fixing roller pair 41 (fixing rollers 41*a* and 41*b*), and an inner sheet discharge roller pair 44 and an outer sheet discharge roller pair 45 for further guiding out the transfer material P discharged from the fixing roller pair 41, onto an external discharge tray 48 projected out of the apparatus. The fixing roller 41*b* as well may be provided with a heat source.

When an image forming operation start signal is transmitted from the control section 80, supply of transfer materials P from one (for example, cassette 21*a*) of the cassettes 21*a* and 21*b* and the tray 27 selected according to the size or the like of the selected transfer materials P is started.

Next, a description will be given of the operation of the image forming apparatus constructed as above.

First, in response to the image forming operation start signal transmitted from the control section 80, transfer materials P are fed one by one by the pickup roller 22*a* e.g. from the upper cassette 21*a*. Then, each transfer material P is conveyed to the registration rollers 25*a* and 25*b* while being guided by the feed roller pair 23 along a conveying path formed by the feed guide 24. At this time, the registration rollers 25*a* and 25*b* are held in stoppage, and hence the leading end of the transfer material P abuts against the nip part between the registration rollers 25*a* and 25*b*. Timing for the start of rotation of the registration rollers 25*a* and 25*b* thereafter is set such that the transfer material P and a toner image primarily transferred onto the intermediate transfer belt 31 meet each other in the secondary transfer area Te.

On the other hand, in the image forming section 10, when the image forming operation start signal is transmitted from the control section 80, a toner image (developed image) formed on the most upstream photosensitive drum 11*d*, as viewed in the direction B of rotation of the intermediate transfer belt 31, is primarily transferred onto the intermediate transfer belt 31 in the primary transfer area Td by the primary-transfer electrostatic charger 35*d* to which a high voltage is applied.

The primarily transferred toner image is conveyed to the next primary transfer area Tc. In the primary transfer area Tc, image formation is performed in timing delayed by a time period required for conveyance of the toner image between adjacent ones of the stations 10*a* to 10*d* of the image forming section 10, and a toner image is transferred onto the image from the immediately upstream primary transfer area Tc, in aligned registration (with image position aligned) with the image from the upstream primary transfer area Tc. Further, a similar operation is carried out in each of the primary transfer areas Tb and Ta for the other colors, and after all, the toner images in the respective four colors are primarily transferred onto the intermediate transfer belt 31.

Thereafter, when the transfer material P enters the secondary transfer area Te and comes into contact with the intermediate transfer belt 31, a high voltage is applied to the secondary transfer roller 36 in timing synchronous with passage of the transfer material P. Then, the toner images in the respective four colors, which are formed on the intermediate transfer belt 31 by the above-described process, are collectively transferred onto the surface of the transfer material P. Thereafter, the transfer material P is accurately guided by the transfer guide 43 to the nip part of the fixing roller pair 41, and the toner image is fixed to the surface of the transfer material P by the heat of the fixing roller pair 41 and the pressure of the nip part. Then, the transfer material P is conveyed by the inner and outer discharge roller pairs 44 and 45 to be discharged onto the external discharge tray 48.

To correct shift in registration, i.e. color displacement (misregistration) in the color images formed on the respective photosensitive drums 11*a* to 11*d*, which occurs in the image forming apparatus of this type due to mechanical mounting errors between the photosensitive drums 11*a* to 11*d*, optical path length errors between laser beams generated by the respective exposure sections 13*a* to 13*d*, variations in optical path, and warpage of the transfer material P caused by the ambient temperature of a LED (light-emitting diode), a registration sensor 60 for detecting misregistration is provided on the primary transfer plane A at a location downstream of all the stations 10*a* to 10*d* of the image forming section 10 and immediately upstream of a turning part of the intermediate transfer belt 31 where the intermediate transfer belt 31 is wound over the drive roller 32.

Figure 4:
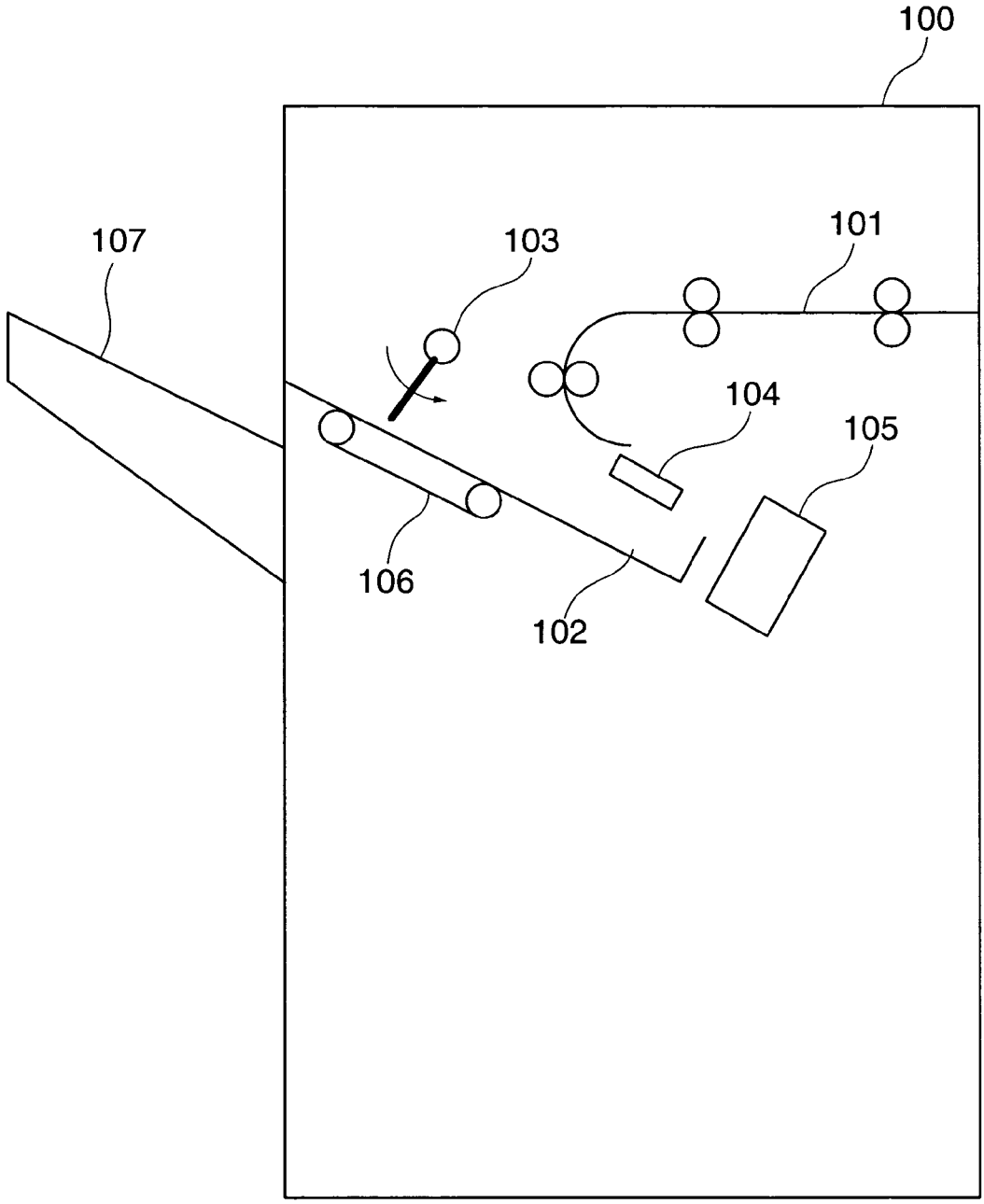
FIG. 4 is a longitudinal cross-sectional view schematically showing the construction of a post-processing unit connected to the image forming apparatus in FIG. 1.

FIG. 4 is a longitudinal cross-sectional view schematically showing the construction of a post-processing unit connected to the downstream side of the image forming apparatus in FIG. 1, for carrying out a bookbinding process.

As shown in FIG. 4, the post-processing unit 100 is connected to a discharge port of the image output section 1P in place of the discharge tray 48. The post-processing unit 100 receives transfer materials P output from the image output section 1P, and discharges the transfer materials P or a bundle of transfer materials P from the unit 100 without executing any processing or after having executed predetermined processing thereon.

When the user gives an instruction for executing stapling processing as the predetermined processing, transfer materials P conveyed by the inner and outer discharge roller pairs 44 and 45 of the image output section 1P are delivered to a conveying path 101 in the post-processing unit 100 and conveyed along the conveying path 101 to be stacked on a processing section 102. Whenever a transfer material P is brought onto the processing section 102, a paddle 103 rotates in a direction indicated by the arrow in FIG. 4 to align the transfer material P with stacked ones. This operation is repeatedly carried out until the number of transfer materials P stacked on the processing section 102 reaches a predetermined number, e.g. ten, that can be designated by the user.

When the predetermined number of, e.g. ten transfer materials P are stacked on the processing section 102, a presser 104 is lowered to press the transfer materials P as a bundle from above. At the same time, the thickness of the transfer material bundle is detected, as described in detail hereinafter, in a state pressed using the presser 104. In the state where the transfer material bundle is pressed by the presser 104, a final processing section 105 is moved to the vicinity of the presser 104 and executes stapling processing as post-processing of image formation by the image output section 1P. The post-processing may be performed using any method available for bookbinding. For example, bonding (pasting) may be carried out.

After completion of the stapling processing, the final processing section 105 returns to its original position, and rollers of a belt conveyor section 106 start rotation to move the belt conveyor section 106 in a direction for discharging the transfer material bundle. The belt conveyor section 106 discharges the processed transfer material bundle onto a discharge tray 107.

Figure 5A:
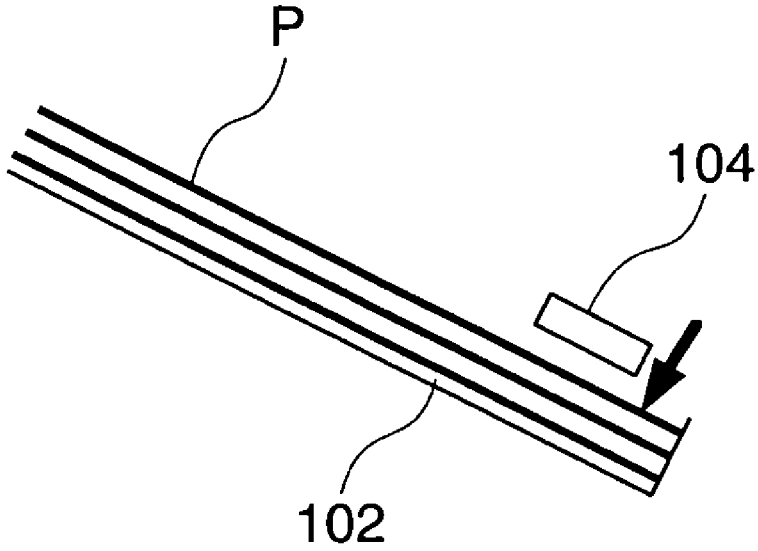
FIGS. 5A and 5B are enlarged longitudinal cross-sectional views showing details of the construction of a bookbinding section of the post-processing unit in FIG. 4.
Figure 5B:
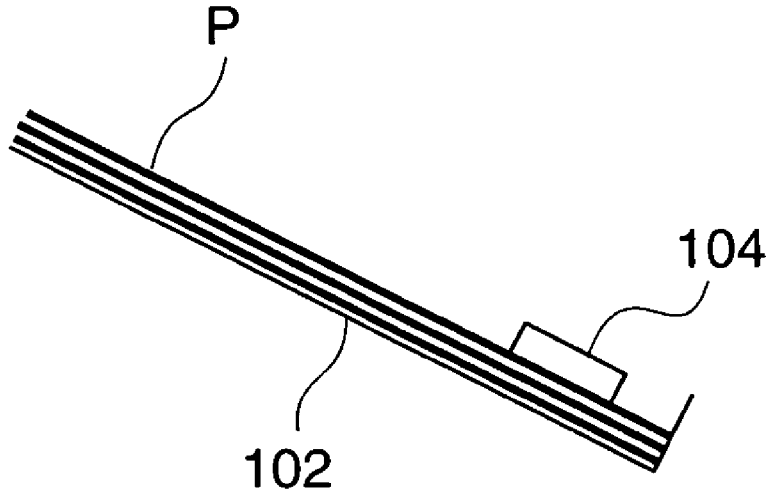

FIGS. 5A and 5B are enlarged longitudinal cross-sectional views of a bookbinding section formed by the processing section 102 and the presser 104 in FIG. 4. When a predetermined number of transfer materials P are stacked as shown in FIG. 5A, the presser 104 is in a state away from the bundle of transfer materials P. Then, the presser 104 is moved in a direction indicated by the arrow in FIG. 5A and stopped in a state pressing the transfer material bundle as shown in FIG. 5B. The presser 104 presses the transfer material bundle to thereby facilitate execution of the stapling processing as well as to make it possible to detect the thickness of the transfer material bundle by a detector section 600, described below with reference to FIG. 6.

Figure 6:
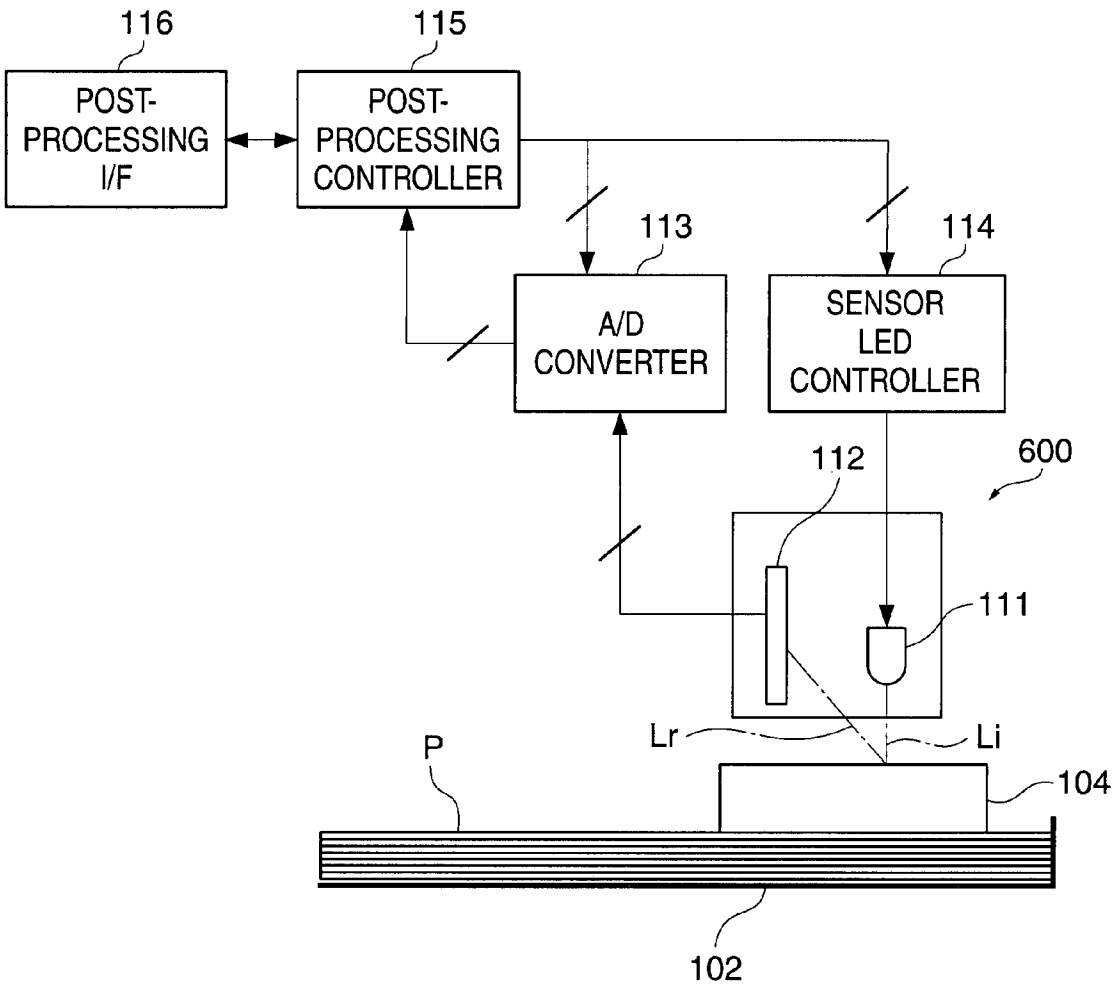
FIG. 6 is a block diagram useful in explaining the concept of bundle thickness-detecting processing executed by the post-processing unit in FIG. 4.

FIG. 6 is a block diagram showing the arrangement of the detector section 600 of the post-processing unit in FIG. 4, which detects the thickness of a transfer material bundle.

In FIG. 6, component parts and elements corresponding to those shown in FIG. 4 are designated by identical reference numerals.

As shown in FIG. 6, the detector section 600 is comprised of a light-emitting diode 111, a light-receiving position sensor 112, an A/D converter 113, and a sensor LED control section 114, and connected to a post-processing control section 115. The post-processing control section 115 is connected to a post-processing interface (I/F) section 116 for communication with the image output section 1P. Further, in FIG. 6, the presser 104 is in a state as shown in FIG. 5B, i.e. in a state pressing the bundle of transfer materials P stacked on the processing section 102.

The post-processing control section 115 is a controller that controls the post-processing unit 100. The post-processing control section 115 also controls the detector section 600.

The post-processing control section 115 is capable of communicating with the control section 80 of the image output section 1P via the post-processing interface (I/F) section 116.

In response to an instruction from the post-processing control section 115, the sensor LED control section 114 transmits an ON signal to the light-emitting diode 111. The light-emitting diode 111 is turned on by this ON signal. Illumination light Li from the light-emitting diode 111 is reflected on a measuring surface of the presser 104, and the reflected light Lr enters a light-receiving surface of the light-receiving position sensor 112. The distance between the measuring surface of the presser 104 and the light-receiving position sensor 112 varies depending on the thickness of the bundle of transfer materials P. For example, as the thickness of the bundle of transfer materials P is larger than a predetermined value, the presser 104 is moved upward and positioned closer to the light-receiving position sensor 112, whereas as the thickness of the bundle of transfer materials P is smaller than the predetermined value, the presser 104 is moved downward and positioned farther away from the light-receiving position sensor 112.

Consequently, a position at which the light-receiving surface of the light-receiving position sensor 112 receives the reflected light Lr changes depending on the thickness of the bundle of transfer materials P, and an analog signal which varies according to a change in the position where the reflected light Lr is incident is input to the A/D converter 113, as a bundle thickness signal indicative of the thickness of the bundle of transfer materials P. Flashing of the light-emitting diode 111 and the light amount of the same are controlled by the ON signal output from the sensor LED control section 114 in response to the control signal from the post-processing control section 115. Further, the post-processing control section 115 also controls A/D converting timing of the A/D converter 113. A digital signal corresponding to the bundle thickness signal is sent from the A/D converter 113 to the post-processing control section 115, where the thickness of the bundle of the transfer materials P is calculated.

Figure 7A:
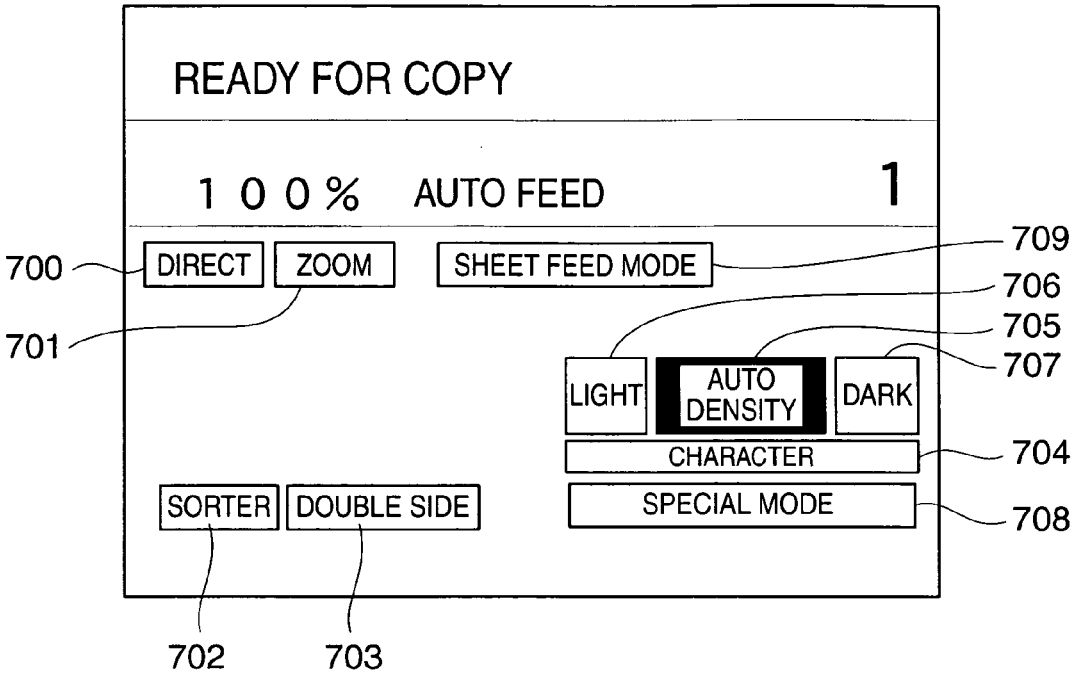
FIGS. 7A and 7B are views of an example of screens displayed on an operating section of the image forming apparatus in FIG. 1.
Figure 7B:
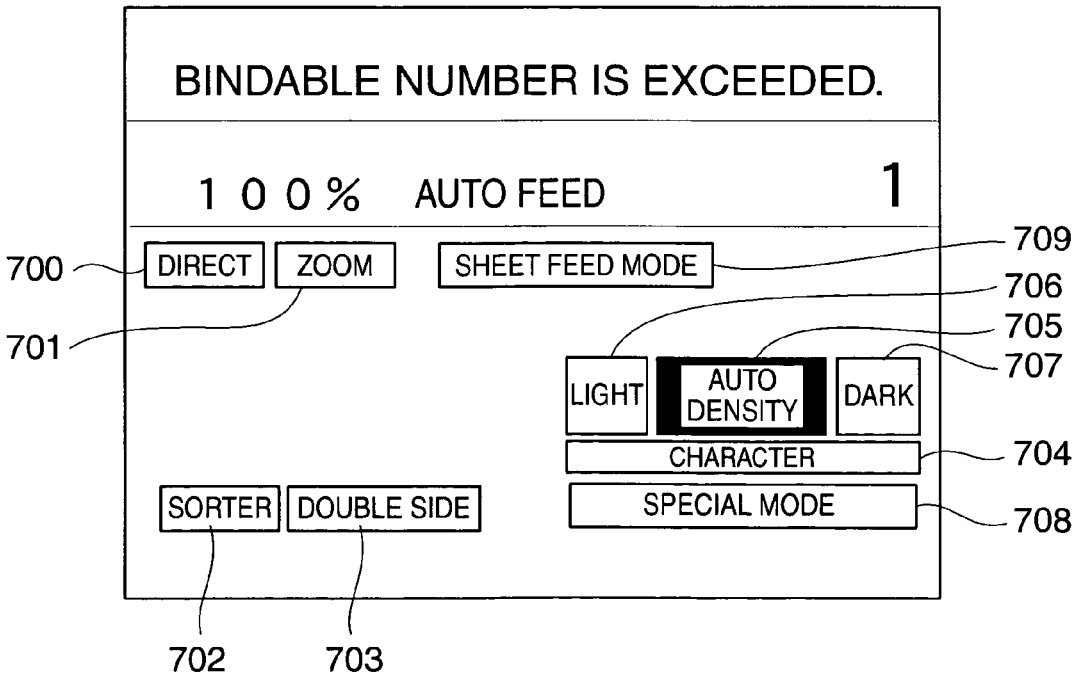

FIGS. 7A and 7B are views of an example of screens displayed on an operating section provided in the image forming apparatus in FIG. 1. On the screens shown in FIGS. 7A and 7B, there are provided the following keys:

A direct key 700 sets the reading magnification factor of the optical system 1R to equimagnification (=100% magnification). A zoom key 701 sets the reading magnification factor to a desired magnification/reduction ratio. The reading magnification factor set by the zoom key 701 is reflected in control of the optical system 1R, including control of the rotational speed of the conveying roller 1305 in a reduction layout mode. A sorter key 702 sets a post-processing mode for sheets to be subjected to post-processing by the post-processing unit 100. A double-sided mode setting key 703 sets either a mode in which printout is executed on only one side of a sheet in the image output section 1R, or a mode in which printout is executed on both sides of a sheet, and either a mode in which data is read from only one side of an original fed by the ADF 1300, or a mode in which data is read from both sides of an original.

An image mode key 704 sets an image reading mode (a character mode, a character/photograph mode, or a photograph mode). An automatic image conversion mode setting key 705 sets the "character mode" or a "background skip mode" in which the background of an original is automatically skipped, regardless of setting of the image reading mode (the character mode, the character/photograph mode, or the photograph mode) by the image mode key 704. A key 706 is for reducing image density in a currently set image reading mode, while a key 707 is for increasing image density in a currently set image reading mode. A special mode key 708 selectively sets various copy modes enabling editing by other image forming apparatuses. A sheet feed selection key 709 selects a sheet feed mode.

The screens shown in FIGS. 7A and 7B may be displayed in an operating section provided in the post-processing unit 100 in FIG. 4.

Next, a description will be given of a case of limiting a sheet bundle by the post-processing unit 100 with reference to FIGS. 8, 9, and 10.

FIG. 8 is a diagram showing an example of a sheet table stored in the image forming apparatus in FIG. 1. The sheet table in FIG. 8 shows information on one of sheets processable by the post-processing unit 100. In FIG. 8, an item "sheet size" defines one of A4, A3, or B4, etc. An item "sheet type" defines one of thin paper, plain sheet, thick paper, very thick paper, etc. Further, an item "sheet thickness" defines a per-sheet thickness (thickness of each sheet) of e.g. 0.1 mm, and an item "bundle limit" defines the number of sheets which can be bound.

The sheet table may be stored in the post-processing unit 100.

FIG. 9 is a diagram of an example of a table showing initial values of the sheet type, the sheet thickness, and the bundle limit in the case where the sheet size is A4 in the sheet table in FIG. 8.

As shown in FIG. 9, e.g. in the case of processing 4A-size plain sheets as set in the sheet table in FIG. 8, the initial values of the sheet size, the sheet type, the sheet thickness, and the bundle limit are set to A4, plain sheet, 0.1 mm, and 200 sheets, respectively. Further, as the bundle limit, an initial value of 20 mm may be set, which is an optimal bundle thickness for processing by the post-processing unit 100, as shown in FIG. 9.

A description will be given of a control operation executed by the post-processing unit 100 with reference to FIG. 10.

Figure 10:
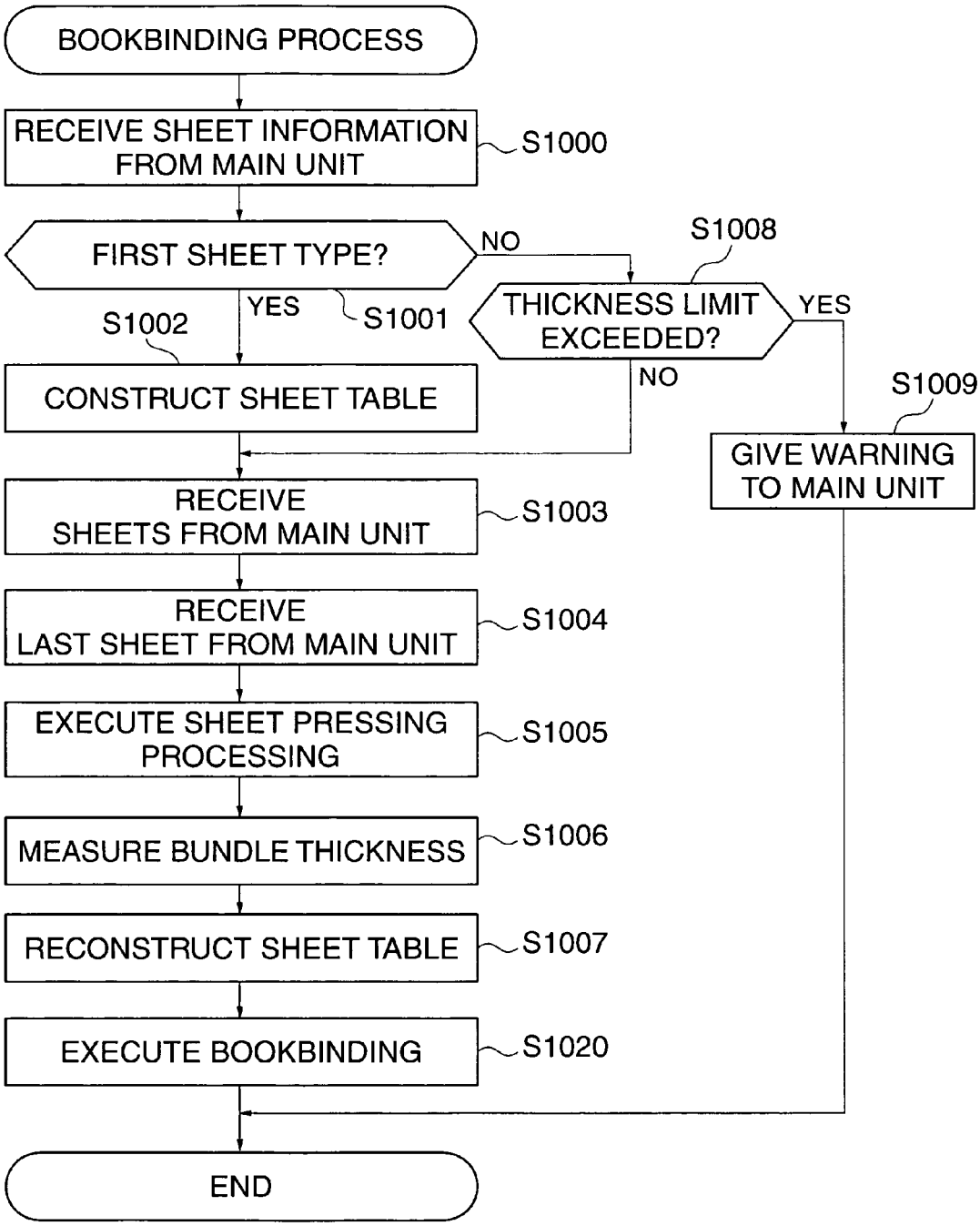
FIG. 10 is a flowchart of a bookbinding process executed by the post-processing unit in FIG. 4.

FIG. 10 is a flowchart of a bookbinding process executed by the post-processing unit 100. The post-processing unit 100 enters a standby state, i.e. a state of readiness for receiving sheets from the image output section 1P (main unit), and receives information on sheets to be conveyed to the post-processing unit 100, from the image output section 1P (step S1000). The information received here indicates a sheet size, a sheet type, and the number of sheets to be processed as a bundle. The information is input to the post-processing control section 115 via the post-processing I/F section 116 of the post-processing unit 100.

The post-processing control section 115 determines whether or not a designated sheet type is one that the post-processing unit 100 handles for the first time (step S1001). If the sheet type is one that the post-processing unit 100 handles for the first time, the sheet table in FIG. 8 is constructed as below, using the initials values in FIG. 9 (step S1002). Now, it is assumed that the information from the image output section 1P indicates that the sheet size is A4, the sheet type plain sheet, and the number of sheets to be processed as a bundle 100, which is set in the sheet table in FIG. 8 as follows:

sheet size: A4
sheet type: plain sheet
sheet thickness: 0.1 mm
bundle limit: 200 sheets (20 mm)

Then, the sheets are successively received from the image output section 1P (step S1003). The received sheets are delivered to the processing section 102 through the conveying path 101. When a final sheet for bundling, which has undergone image formation processing, is received from the image output section 1P (step S1004), and the 100th sheet is stored in the processing section 102, the presser 104 is lowered to press the sheet bundle of 100 sheets (step S1005). In this state, the post-processing control section 115 drives the sensor LED control section 114 to turn on the light-emitting diode 111. At the same time, the post-processing control section 115 converts a value obtained by analog-to-digital conversion by the A/D converter 113 into thickness information (mm) to thereby measure the thickness of the sheet bundle (step S1006). Assuming that the measured sheet bundle thickness is 8 mm, a per-sheet thickness is calculated as follows:

8 mm/100 sheets=0.08 mm

Further, based on the value calculated as above, a bundle limit is calculated as follows:

20 mm/0.08 mm=250 sheets

When the results are stored in the sheet table constructed in the step S1002, the sheet table is reconstructed as follows (step S1007):

sheet size: A4 sheet type: plain sheet sheet thickness: 0.08 mm bundle limit: 250 sheets (20 mm)

In the initial setting, the limit of the number of sheets processable in post processing was set to 200 sheets, but as a consequence of the calculation based on the thickness of the currently used sheet, the limit is changed such that post processing of up to 250 sheets is allowed.

After reconstruction of the sheet table in the step S1007, the post-processing unit 100 executes bundling (bookbinding), such as stapling or pasting (bonding), and then discharges the sheet bundle from the unit (step S1020), followed by terminating the present process.

In the process in FIG. 10, the sheet table may be repeatedly reconstructed by counting the sheets received from the image output section 1P in the steps S1003 to S1004 and then repeatedly carrying out the steps S1004 to S1007.

A description will be given of the case where it is determined in the step S1001 in FIG. 10 that the designated sheet type is not one that the post-processing unit 100 handles for the first time, by taking the case where the A4-size plain sheet is designated again by the image output section 1P, as an example.

In this case, it is determined, with reference to the prepared sheet table (thickness: 0.08 mm, bundle limit: 250 sheets), whether or not the sheets can be bundled (step S1008). If the number of sheets to be received from the image output section 1P and processed as a bundle is 200, post processing is possible, so that the process proceeds to the step S1003, wherein normal processing is executed.

On the other hand, if the number of sheets to be received from the image output section 1P and processed as a bundle is 260, a warning to the effect that processing is impossible is given to the operating section (step S1009) In this case, the warning is given by displaying a message, such as "Bindable number is exceeded", on the operating section as shown in FIG. 7B, followed by terminating the present process.

The post-processing unit 100 may be configured to notify the user that bundling is impossible, after receiving the instruction from the image output section 1P, or transmit a sheet-number limit signal to the image output section 1P before the instruction from the image output section 1P is received.

Next, a description will be given of a variation of the present embodiment with reference to FIG. 11. In the present variation, limitation of a sheet bundle is executed in the optical system 1R, the image output section 1P, and the post-processing unit 100.

A description will be given of a control operation executed mainly by the image output section 1P with reference to FIG. 11.

Figure 11:
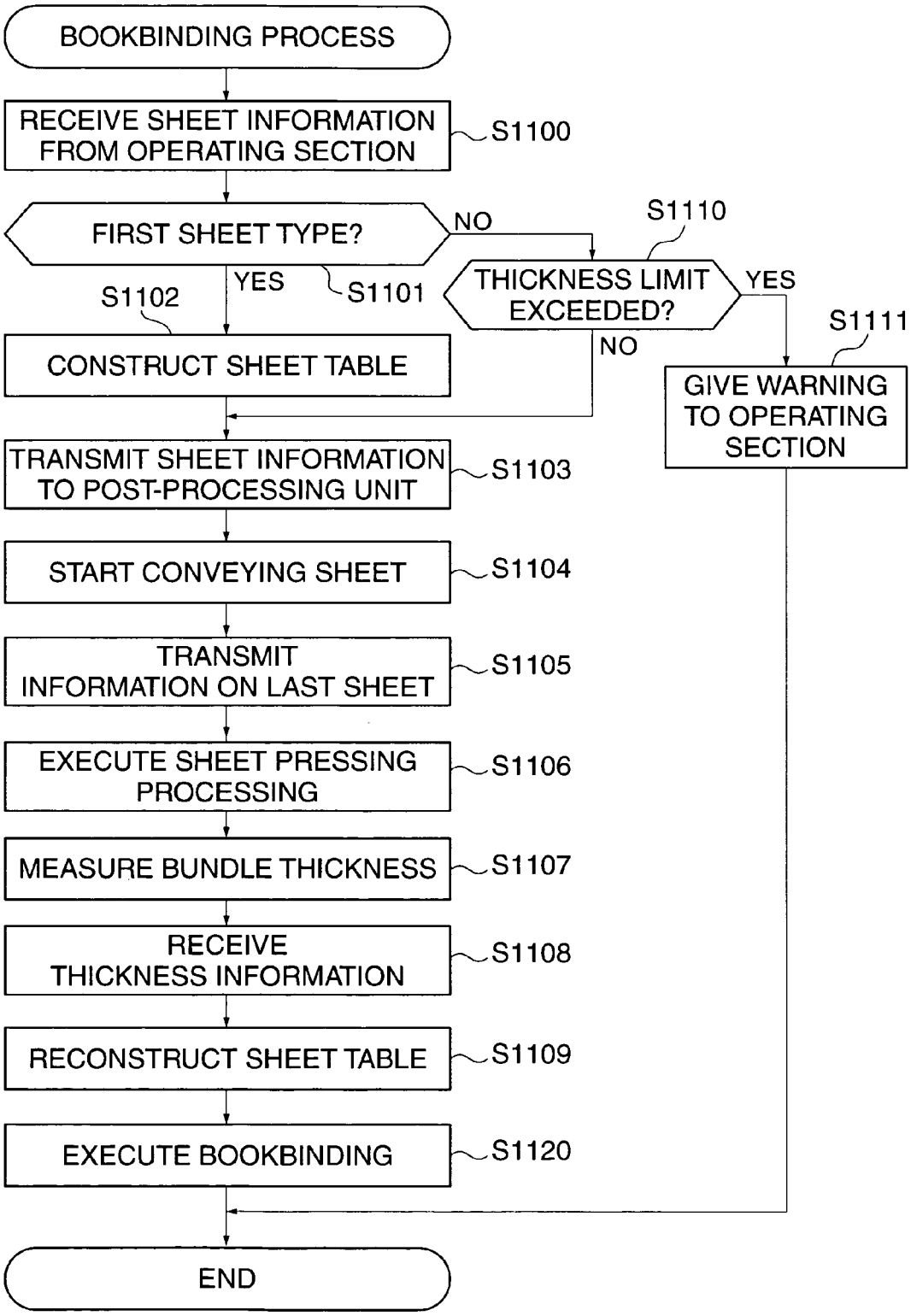
FIG. 11 is a flowchart of a bookbinding process executed in a variation of the embodiment of the present invention.

FIG. 11 is a flowchart of a bookbinding process executed mainly by the image output section 1P according to the present variation.

The optical system 1R, the image output section 1P, and the post-processing unit 100 enter a standby state, and the user selects one of the cassettes 21*a* and 21*b*, and the manual feed tray 27 in FIG. 1 via the operating section in FIG. 7A. When originals are placed on the ADF 1300 and a copy key is pressed, the number of the originals is counted. The number of sheets to be output is calculated based on the number of the originals and a mode (e.g. the double-sided mode) set via the operating section (step S1100). Now, it is assumed that the number of sheets to be output is 100, and that the sheets stored in the designated sheet feed stage are A4-size plain sheets. It is determined whether or not the designated sheet type is one that the image output section 1P handles for the first time (step S1101). If the designated sheet type is one that the image output section 1P handles for the first time, the sheet table is constructed as below, using the initials values in FIG. 9 (step S1102). Now, it is assumed that information from the image output section 1P indicates that the sheet size is A4, the sheet type plain sheet, and the number of sheets to be processed as a bundle 100.

Sheet information (sheet table) of the sheets in the selected cassette is constructed as follows:

sheet size: A4 sheet type: plain sheet sheet thickness: 0.1 mm bundle limit: 200 sheets (20 mm)

Since the post-processing unit 100 is capable of processing a sheet bundle having a thickness of up to 20 mm, and the number of sheets to be output is 100, the cassette sheet information indicating that the sheet size is A4, the sheet type plain sheet, and the number of sheets to be processed as a bundle 100 is transmitted to the post-processing unit 100 (step S1103). When the post-processing unit 100 completes preparation for receiving sheets, the image output section 1P starts conveying the sheets from the selected cassette to the post-processing unit 100 (step S1104). When the 100th sheet is conveyed to the post-processing unit 100, the image output section 1P transmits to the post-processing unit 100 information indicating that the final sheet for bundling, which has undergone image formation processing, has been discharged (step S1105). The post-processing unit 100 successively receives the sheets from the image output section 1P, and sequentially delivers the sheets to the processing section 102 through the conveying path 101.

When the final sheet is received from the image output section 1P, and the 100th sheet is stored in the processing section 102, the presser 104 is lowered to press the sheet bundle of 100 sheets (step S1106). In this state, the post-processing control section 115 drives the sensor LED control section 114 to turn on the light-emitting diode 111. At the same time, the post-processing control section 115 converts a value obtained by analog-to-digital conversion by the A/D converter 113 into thickness information (mm) to thereby measure the thickness of the sheet bundle (step S1107). Assuming that the measured sheet bundle thickness is 8 mm, the per-sheet thickness is calculated as follows:

8 mm/100 sheets=0.08 mm

This calculated value (per-sheet thickness) is transmitted to the image output section 1P (step S1108).

In the image output section 1P, the received per-sheet thickness (0.08 mm) is reflected in the cassette sheet information constructed in the step S1102.

The bundle limit is calculated as 20 mm/0.08 mm=250 sheets, so that when the results are reflected in the cassette sheet information constructed in the step S1102, the cassette sheet table (see FIG. 8) is reconstructed as follows (step S1109):

sheet size: A4
sheet type: plain sheet
sheet thickness: 0.08 mm
bundle limit: 250 sheets (20 mm)

In the initial setting, the limit of the number of sheets processable in post processing was set to 200, but as a consequence of the calculation based on the thickness of the currently used sheet, the limit is changed such that post processing of up to 250 sheets is allowed.

After reconstruction of the sheet table, the post-processing unit 100 executes bundling (bookbinding), such as stapling or pasting (bonding), and then discharges the sheet bundle from the unit (step S1120), followed by terminating the present process.

A description will be given of the case where it is determined in the step S1101 in FIG. 11 that the designated sheet type is not one that the post-processing unit 100 handles for the first time by taking the case where the A4-size plain sheet is designated again by the image output section 1P, as an example.

In this case, it is determined, with reference to the prepared sheet table (thickness: 0.08 mm, bundle limit: 250 sheets), whether or not the sheets can be bundled (step S1110). If the number of sheets to be received from the image output section 1P and processed as a bundle is 200, post processing is possible, so that the process proceeds to the step S1103, wherein normal processing is executed.

On the other hand, if the number of sheets to be received from the image output section 1P and processed as a bundle is 260, a warning to the effect that processing is impossible is given to the operating section (step S1111). In this case, the warning is given by displaying a message, such as "Bindable number is exceeded", on the operating section as shown in FIG. 7B, followed by terminating the present process.

As described above, according to the present embodiment, it is possible to measure the thickness of a sheet actually output from the image output section 1P in the post-processing unit 100, and reflect the measured sheet thickness in the number of sheets which can be post-processed, so that optimal bookbinding according to the sheet thickness can be performed, which prevents occurrence of wrinkling or faulty binding, such as corner folding, in the finish of bookbinding. Further, the present embodiment makes it possible to bind the maximum possible number of sheets. Furthermore, since the thickness of a sheet is measured after the sheet has passed through the fixing device (fixing roller pair 41), it is possible to measure sheet thickness more suitably for binding processing executed after the sheet having passed through the fixing device.

As described above, according to the embodiment of the present invention, the thickness of a sheet bundle to be processed is detected, and then the upper limit of the number of sheets that can be bundled or that of sheet thickness is changed based on the detected thickness of the sheet bundle, so that optimal bundling, such as bookbinding process, can be performed according to the thickness of the currently used sheet, which makes it possible not only to prevent occurrence of faulty binding, such as wrinkling or corner folding in the finish of bookbinding, but also to bind the maximum possible number of sheets. Moreover, since the upper limit of the number of sheets that can be processed is set based on the sheet thickness, it is possible to prevent corner folding or wrinkling from occurring when sheets larger in sheet thickness than expected are stored in the post-processing unit.

Further, since the thickness of a sheet bundle to be processed is detected with the sheet bundle sandwiched or pressed after the sheets have passed through the fixing device, the detection can be performed in a state where water has already evaporated from the sheets and each of the sheets contains no air spaces, as well as in a state where there is no space between sheets, which makes it possible to accurately measure the thickness of the sheet bundle for sheet bundling.

Further, sheet thickness information is stored as initial value information in a predetermined storage section in association with each of sheet storage sections, such as sheet feed stages, and the sheet thickness information is updated according to the detected sheet bundle thickness. Therefore, it is possible to execute processing more suitably for precise sheet bundling, such as bookbinding, as well as to handle sheets having a new sheet thickness which cannot be handled based on sheet type information (thickness information) stored in advance in the main unit.

Furthermore, the number of sheets to be bundled is counted, and then the detected sheet bundle thickness is converted into per-sheet thickness, so that even if the sheet bundle has a plurality of types of sheets mixed therein, it is possible to handle sheets having a new sheet thickness which cannot be handled based on sheet type information (thickness information) stored in advance in the main unit.

Moreover, since the per-sheet thickness obtained by conversion from the detected thickness of a sheet bundle is reflected in the per-sheet thickness of sheets contained in a sheet storage section, processing for calculating the limit of the number of sheets or the limit of thickness can be facilitated.

Further, since the detected sheet bundle thickness is converted into per-sheet thickness based on a number obtained by counting the number of sheets to be bundled, the maximum number of sheets that can be bundled by the apparatus can be easily calculated from the per-sheet thickness, which makes it possible to execute precise sheet bundling, such as bookbinding, as well as to provide a processable number that allows the best execution of the binding processing.

Further, the number of sheets to be output, which is calculated based on the number of originals and a processing mode such as a copy mode, is compared with the number of sheets that can be bundled, and when the calculated number is larger than the number of sheets that can be bundled, a warning is given to the user. Thus, the user can be informed of the fact before faulty binding, such as wrinkling or corner folding, is caused by forcible execution of processing for bundling sheets larger in sheet thickness than expected.

If sheet feed stage information is also provided, it is possible to give a more exact warning to the user.

Furthermore, since the user is informed, upon determination of the number of sheets to be output and a sheet feed stage to be used, that execution of precise bundling is impossible, it is possible to prevent output of a sheet bundle processed by rough bundling which causes wrinkling, corner folding, or jamming in the bookbinding section.

Furthermore, since the thickness of bundled sheets is detected in a state where the bundled sheets are pressed, the thickness can be detected in a state closer to that in the final step of the bookbinding process, which makes it possible to provide precise bookbinding processing.

The present invention is not limited to the above described embodiment, but can be modified in various manners based on the subject matter of the present invention, which should not be excluded from within the scope of the present invention insofar as functions as recited in the appended claims or the functions performed by the construction of the above described embodiment can be achieved.

Further, it is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network from another computer, a database, or the like, not shown, connected to the Internet, a commercial network, a local area network, or the like.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

CROSS REFERENCE TO RELATED APPLICATION

This application claims priority from Japanese Patent Application No. 2004-211473 filed Jul. 20, 2004, which is hereby incorporated by reference herein.

What is claimed is:

1. A sheet processing apparatus for processing a plurality of sheets as a bundle comprising:

a sheet bundle thickness-detecting sensor that detects a thickness of the bundle of sheets;

a sheet counter that counts a number of sheets processed as a bundle;

a sheet thickness-calculating device that calculates a thickness of each sheet based on the thickness of the bundle of sheets detected by said sheet bundle thickness-detecting sensor and the number of sheets counted by said sheet counter;

a sheet thickness information storage section that stores per-sheet thickness information indicative of the thickness of each sheet and a bundle upper limit indicative of a number of sheets that can be processed as the bundle for each sheet; and a rewriting device that rewrites the per-sheet thickness information and the bundle upper limit stored in said sheet thickness information storage section, according to the thickness of each sheet calculated by said sheet thickness-calculating device.

2. A sheet processing apparatus as claimed in claim 1, further comprising a pressing member that presses the bundle of sheets, and wherein said sheet bundle thickness-detecting sensor detects the thickness of the bundle of sheets in a state where the bundle of sheets is pressed by said pressing member.

3. A sheet processing apparatus as claimed in claim 1, wherein said sheet thickness-calculating device calculates the thickness of each sheet by dividing the thickness of the bundle of sheets detected by said sheet bundle thickness-detecting sensor by a count value of said sheet counter.

4. A sheet processing apparatus as claimed in claim 1, further comprising:

a determining device that determines whether or not the plurality of sheets are to be used for a first time; and wherein the sheet thickness information storage section is operable when said determining device determines the plurality of sheets are to be used for the first time, to construct and store a table containing the per-sheet thickness information and the bundle upper limit.

5. A sheet processing apparatus as claimed in claim 1, further comprising:

an original counter that counts a number of originals;

a processing mode-designating device that designates one processing mode selected from the group consisting of a single-sided mode, a double-sided mode, and a reduction layout mode;

an output sheet number-calculating device that calculates a number of the sheets to be outputted for processing, based on a count value of said original counter, and the processing mode designated by said processing mode-designating device; and a warning device that compares the number of the sheets to be outputted calculated by said output sheet number-calculating device with the bundle upper limit of the number of sheets that can be processed as a bundle, and gives a warning when the number of the sheets to be outputted exceeds the bundle upper limit.

6. A sheet processing apparatus as claimed in claim 1, further comprising:

an original counter that counts a number of originals;

a processing mode-designating device that designates one processing mode selected from the group consisting of a single-sided mode, a double-sided mode, and a reduction layout mode;

an output sheet number-calculating device that calculates a number of the sheets to be outputted for processing, based on a count value of said original counter, and the processing mode designated by said processing mode-designating device;

a setting device that sets at least one of a sheet feed stage and a type of the sheets to be processed; and a warning device that compares the number of the sheets to be outputted calculated by said output sheet number-calculating device with the bundle upper limit of the number of sheets that can be processed as a bundle using at least one of the sheet feed stage or the type of the sheets to be processed set by said setting device, and gives a warning when the number of the sheets to be outputted exceeds the bundle upper limit.

7. A sheet processing apparatus as claimed in claim 1, further comprising:

a setting device that sets a sheet feed stage;

an output sheet number-calculating device that calculates a number of the sheets to be outputted for processing; and a warning device that compares the bundle upper limit of the number of the sheets that can be processed as a bundle determined from the per-sheet thickness information set for the set sheet feed stage, with the calculated number of the sheets to be outputted, and gives a warning when the calculated number of the sheets to be outputted exceeds the bundle upper limit.

8. A method of controlling a sheet processing apparatus that processes a plurality of sheets as a bundle, comprising:

a sheet bundle thickness-detecting step of detecting a thickness of the bundle of sheets;

a sheet counting step of counting a number of sheets to be processed as a bundle;

a sheet thickness-calculating step of calculating a thickness of each sheet based on the thickness of the bundle of sheets detected in said sheet bundle thickness-detecting step and the number of sheets counted in said sheet counting step;

a sheet thickness information storing step of storing per-sheet thickness information indicative of the thickness of each sheet and a bundle upper limit indicative of a number of sheets that can be processed as the bundle for each sheet in a sheet thickness information storage section; and rewriting step of rewriting the per-sheet thickness information and the bundle upper limit stored in said sheet thickness information storage section, according to the thickness of each sheet calculated in said sheet thickness-calculating step.

9. A method as claimed in claim 8, further comprising a pressing step of pressing the bundle of sheets, and wherein said sheet bundle thickness-detecting step comprises detecting the thickness of the bundle of sheets in a state where the bundle of sheets is pressed in said pressing step.

10. A method as claimed in claim 8, wherein said sheet thickness-calculating step comprises calculating the thickness of each sheet by dividing the thickness of the bundle of sheets detected in said sheet bundle thickness-detecting step by a count value obtained in said sheet counting step.

11. A method as claimed in claim 8, further comprising:

a determining step of determining whether or not the plurality of sheets are to be used for a first time; and wherein the sheet thickness information storing step includes constructing and storing a table containing per-sheet thickness information indicative of the thickness of each sheet calculated in said sheet thickness-calculating step, when said determining step determines that the plurality of sheets are to be used for the first time.

12. A method as claimed in claim 8, further comprising:

an original counting step of counting a number of originals;

a processing mode-designating step of designating one processing mode selected from the group consisting of a single-sided mode, a double-sided mode, and a reduction layout mode;

an output sheet number-calculating step of calculating a number of the sheets to be outputted for processing, based on a count value obtained in said original counting step, and the processing mode designated in said processing mode-designating step; and a warning step of comparing the number of the sheets to be outputted calculated in said output sheet number-calculating step with the bundle upper limit of the number of sheets that can be processed as a bundle, and giving a warning when the number of the sheets to be outputted exceeds the bundle upper limit.

13. A method as claimed in claim 8, further comprising:

an original counting step of counting a number of originals;

a processing mode-designating step of designating one processing mode selected from the group consisting of a single-sided mode, a double-sided mode, and a reduction layout mode;

an output sheet number-calculating step of calculating a number of the sheets to be outputted for processing, based on a count value obtained in said original counting step, and the processing mode designated in said processing mode-designating step;

a setting step of setting at least one of a sheet feed stage and a type of the sheets to be processed; and a warning step of comparing the number of the sheets to be outputted calculated by said output sheet number-calculating device with the bundle upper limit of the number of sheets that can be processed as a bundle using at least one of the sheet feed stage or the type of the sheets to be processed set in said setting step, and giving a warning when the number of the sheets to be outputted exceeds the bundle upper limit.

14. A method as claimed in claim 8, further comprising:

a setting step of setting a sheet feed stage;

an output sheet number-calculating step of calculating a number of the sheets to be outputted for processing; and a warning step of comparing the bundle upper limit of the number of the sheets that can be processed as a bundle determined from the per-sheet thickness information set for the set sheet feed stage, with the calculated number of the sheets to be outputted, and gives a warning when the calculated number of the sheets to be outputted exceeds the bundle upper limit.

15. A computer-readable medium storing a computer program for causing a computer to execute a method of controlling a sheet processing apparatus that processes a plurality of sheets as a bundle, the computer program comprising:

a sheet bundle thickness-detecting step of detecting a thickness of the bundle of sheets;

a sheet counting step of counting a number of sheets to be processed as a bundle;

a sheet thickness-calculating step of calculating a thickness of each sheet based on the thickness of the bundle of sheets detected by said sheet bundle thickness-detecting step and the number of sheets counted by said sheet counting step;

a sheet thickness information storing step of storing per-sheet thickness information indicative of the thickness of each sheet and a bundle upper limit indicative of a number of sheets that can be processed as the bundle for each sheet in a sheet thickness information storage section; and rewriting step of rewriting the per-sheet thickness information and the bundle upper limit stored in said sheet thickness information storage section, according to the thickness of each sheet calculated by said sheet thickness-calculating step.

16. A computer-readable storage medium storing a computer program for controlling a sheet processing apparatus that processes a plurality of sheets as a bundle, said computer program including:

a sheet bundle thickness-detecting module for detecting a thickness of the bundle of sheets;

a sheet counting module for counting a number of sheets to be processed as a bundle;

a sheet thickness-calculating module for calculating a thickness of each sheet based on the thickness of the bundle of sheets detected by said sheet bundle thickness-detecting module and the number of sheets counted by said sheet counting module;

a sheet thickness information storing module for storing per-sheet thickness information indicative of the thickness of each sheet and a bundle upper limit indicative of a number of sheets that can be processed as the bundle for each sheet in a sheet thickness information storage section; and a rewriting module for rewriting the per-sheet thickness information and the bundle upper limit stored in said sheet thickness information storage section, according to the thickness of each sheet calculated by said sheet thickness-calculating module.

* * * * *